US011857040B2

(12) United States Patent
Khinduka

(10) Patent No.: US 11,857,040 B2
(45) Date of Patent: Jan. 2, 2024

(54) SPINNABLE JEWELRY

(71) Applicant: VAN HOLDINGS LIMITED, Hong Kong (CN)

(72) Inventor: Yash Khinduka, Hong Kong (CN)

(73) Assignee: VAN HOLDINGS LIMITED, Hong Kong (CN)

( * ) Notice: Subject to any disclaimer, the term of this patent is extended or adjusted under 35 U.S.C. 154(b) by 0 days.

(21) Appl. No.: 17/613,502

(22) PCT Filed: Jun. 8, 2021

(86) PCT No.: PCT/CN2021/098760
§ 371 (c)(1),
(2) Date: Nov. 23, 2021

(87) PCT Pub. No.: WO2021/249362
PCT Pub. Date: Dec. 16, 2021

(65) Prior Publication Data

US 2023/0092219 A1 Mar. 23, 2023

(30) Foreign Application Priority Data

Jun. 8, 2020 (HK) ..... 32020008832.8

(51) Int. Cl.
*A44C 7/00* (2006.01)
*A44C 9/00* (2006.01)
(Continued)

(52) U.S. Cl.
CPC ..... *A44C 9/00* (2013.01); *A44C 5/00* (2013.01); *A44C 7/00* (2013.01); *A44C 13/00* (2013.01); *A44C 17/02* (2013.01)

(58) Field of Classification Search
CPC .... A44C 9/00; A44C 5/00; A44C 7/00; A44C 13/00; A44C 17/02; A44C 17/0258;
(Continued)

(56) References Cited

U.S. PATENT DOCUMENTS 1,672,355 A * 6/1928 Ullman ..... A44C 9/00 63/15
1,747,892 A * 2/1930 Fisher ..... A47G 33/10 24/372
(Continued)

FOREIGN PATENT DOCUMENTS

JP 11266914 A * 10/1999 ..... A44C 17/0266

*Primary Examiner* — Jack W Lavinder
(74) *Attorney, Agent, or Firm* — George G. Wang; Bei & Ocean

(57) ABSTRACT

Disclosed is a spinnable jewelry item, including: a rotating assembly having a rotating face and a main shaft connected with the rotating face, the rotating face rotating with the main shaft as axis; a positioning assembly having a positioning face, the positioning face elastically abutting against the rotating face along the axial direction of the main shaft; a protrusion and a recess opposite the protrusion being provided on opposite surfaces of the positioning face and the rotating face; when the rotating face is rotated, the protrusion enters or exits the recess; an elastic element applying an elastic force against the positioning assembly, such that the positioning face resiliently abutting against the rotating face; a main body part having an opening structure, wherein the main shaft is rotatably connected with the bottom of the opening structure after passing through the positioning assembly and the elastic element, and the positioning assembly and the elastic element are disposed in the opening structure. the spinnable jewelry item has a structure that can be rotated to be positioned, such that various vies of the jewelry item can be well presented, thereby better satisfying a consumer's demands on versatility.

20 Claims, 3 Drawing Sheets

(51) Int. Cl.

| | |
|---|---|
| ***A44C 25/00*** | (2006.01) |
| ***A44C 5/00*** | (2006.01) |
| ***A44C 13/00*** | (2006.01) |
| ***A44C 17/02*** | (2006.01) |

(58) Field of Classification Search
CPC ... A44C 17/0266; A44C 25/00; A44C 25/001; A44C 25/007; A44C 15/00
USPC ..... 63/35, 38
See application file for complete search history.

(56) References Cited

U.S. PATENT DOCUMENTS

| | | | | | |
|---|---|---|---|---|---|
| 1,747,893 | A * | 2/1930 | Fisher | A47G 33/10 | 24/370 |
| 2,514,231 | A * | 7/1950 | Fous | A44C 9/00 | 63/15 |
| 3,805,549 | A * | 4/1974 | Nielsen | A44C 15/001 | 63/29.1 |
| 8,191,849 | B1 * | 6/2012 | Lembke | A47G 7/047 | 248/692 |
| 2019/0246753 | A1 * | 8/2019 | Lin | A44C 5/12 | |

* cited by examiner

SPINNABLE JEWELRY

FIELD

Embodiments of the present disclosure relate to jewelry ornaments, and more particularly relate to a spinnable jewelry item.

BACKGROUND

Social development boosts consumption level, where jewelry articles of all sorts are increasingly sought after. The desire to look attractive is universal. Conventional jewelry, as ornaments daily worn by people, serves that purpose. With rapid development of the modern jewelry industry, novel functional attributes have emerged to be adapted to the consumers' cravings for innovative and diversified jewelry products, such that jewelry is more than a personal ornament, but an item for a wearer to fidget at will and manifesting the wearer's personality. However, owing to its invariable pattern or complex structure, the jewelry currently available in the market cannot satisfy the consumers' demands on versatile jewelry designs.

SUMMARY

An objective of the present disclosure is to provide a spinnable jewelry item, which has a variable, rotatably positioned structure, such that various views of the jewelry item can be better presented and consumer demand on versality can be satisfied, thereby solving the above and more drawbacks.

To achieve the objective above, the present disclosure is implemented through the following technical solution:

a spinnable jewelry item, comprising:

a rotating assembly, which has a rotating face and a main shaft connected with the rotating face, wherein the rotating face rotates about the main shaft as axis;

a positioning assembly, which has a positioning face, wherein the positioning face elastically abuts against the rotating face along the axial direction of the main shaft; a protrusion and a recess opposite the protrusion are provided on opposite surfaces of the positioning face and the rotating face, respectively, such that when the rotating face is rotated, the protrusion enters or exits the recess, wherein when the protrusion enters the recess, a position where the rotating face lies in a stationary state is defined;

an elastic element, which applies an elastic force to the positioning assembly, such that the positioning face elastically abuts against the rotating face; and a main body part, which has an opening structure, wherein the main shaft is rotatably connected to the bottom of the opening structure after passing through the positioning assembly and the elastic element, the positioning assembly and the elastic element being disposed in the opening structure.

Conventional jewelry is mostly invariable in pattern and thus has less fun and versatility. Even there is a movable part, such jewelry generally can only wobble randomly with mobility of the wearer, being hardly fixed to a particular angle. In the present disclosure, since the rotating assembly in the spinnable jewelry item is rotatable, the jewelry item can vary its pattern. The present disclosure further provides a positioning assembly, wherein the positioning face and the rotating face may not only rotate relative to each other, but also may be fixed at a recessed position where the rotated jewelry item stays. To achieve a better spinning effect, an elastic element is specifically provided to enable resilient abutting between the positioning face and the rotating face. When it is not desired to spin the jewelry item, the elastic force enables the protrusion to be depressed into the recess, thereby fixing the position of the rotating face; when it is desired to spin the jewelry item, the jewelry item can be rotated by overcoming the friction generated by the elastic force. The main body part provides a base for mounting and rotating the rotating assembly, the positioning assembly, and the elastic element, wherein the opening structure of the main body part serves to fix the rotated position of the main shaft and meanwhile conceal the components therein so as not to affect the appearance of the jewelry item. Therefore, the spinnable jewelry item in this solution can be rotated and positioned. When wearing it, the wearer may fidget with the jewelry item at will at any time and exhibit respective views of the jewelry item, thereby enhancing interactivity between the jewelry item and the wearer and better satisfying the wearer's demand on versality.

Dispositions of the protrusion and the recess are interchangeable between the rotating face and the positioning face. For example, the protrusion is disposed on the rotating face, while the recess is provided on the positioning face at the trajectory along which the protrusion rotates. Or, the recess is disposed on the rotating face, while the protrusion is provided on the positioning face at the trajectory along which the recess rotates. In the present disclosure, the protrusion and the recess serve to fix the stationary position of the rotating face where rotating is suspended; the protrusion and the recess are separately disposed in correspondence on the rotating face and the positioning face. As to layout of the specific positions of the protrusion and the recess, it is configured that when one of the protrusion and the recess is rotating, the other one is positioned at the trajectory of rotating so as to ensure that the protrusion is snapped into the recess after the rotating, thereby exerting the recess's role of stationary positioning.

The numbers of the protrusion and recess may be flexibly provided based on desired spinning and varying patterns of the jewelry item. Preferably, four recesses are disposed at even intervals with every two neighboring recesses forming a right angle, wherein the four recesses correspond to four stationary-state positions of the rotating face, respectively. Such settings enable support and positioning at all of the 0°, 90°, 180°, and 270° angles, and the four-angle symmetrical structure ensures a balanced. stable stress, causing the jewelry item unlikely to wobble.

Furthermore, desired rotation and positioning may be realized so long as the number of the recesses is equal to or greater than the number of the protrusions. When the number of the recesses is equal to that of the protrusions, the recesses are in exactly one-to-one correspondence with the protrusions, realizing a more stable rotation; when the number of the recesses is greater than that of the protrusions, multi-point positioning is enabled and manufacturing is simplified.

The protrusion and recess may also adopt a variety of shapes. Preferably, the protrusion is a semi-spherical protrusion, while the recess is a semi-spherical slot adapted to the protrusion. As the semi-spherical shape has a regular spherical surface, it is easily manufactured. Moreover, the arc-shaped profile of the spherical surface facilitates the protrusion to switch between recesses during the spinning; and since less effort is needed for the switching operation, the jewelry item is adapted for frequent spinning.

Alternatively, the protrusion has an arc shape with a curved surface while the recess is an arc-shaped slot adapted to the protrusion. The arc-shaped protrusion has a smooth edge, such that when spinning, the protrusion may easily switch between recesses, facilitating the user to spin the jewelry item at will. Different arc shapes enable the jewelry to vary the rotating force and rotating state during spinning, thereby enhancing playability of the spinning.

Or, the protrusion is a wedge-shaped protrusion with a beveled surface and the recess is a wedge-shaped slot adapted to the protrusion. Compared with other shapes, the beveled surface facilitates the wedge-shaped protrusion to rotate out of the corresponding recess during spinning, but is more difficultly displaced than the arc-shaped surface. In this way, motion variations are generated, thereby enhancing playability of the spinning.

Furthermore, the elastic force applied by the elastic element also facilitates a protrusion to be quickly pushed into the corresponding recess, such that during the spinning, the protrusion may quickly switch from one recess into another recess to be positioned, thereby offering a better hand sense during the spinning.

Furthermore, a clash sound is emitted when the protrusion is pushed into the recess. A continuous clash sound is emitted during a continuous spinning. The user may sense a noticeable hand feedback and receive a position-switching alarm during the spinning. Different clash sounds may be emitted by setting the material and resiliency of the clashed surfaces. Such clash sounds may also provide more fun when the user wears the spinnable jewelry item of the present disclosure.

Furthermore, the elastic element is a helical spring, one end of which abuts against the bottom of the opening structure and the other end of which abuts against the positioning assembly, wherein the main shaft penetrates through the center of the helical spring. Owing to its miniature structure, the helical spring is suitable for being embedded in a miniature jewelry item; besides, the helical spring supplies a stable elastic force and has a mature manufacture process, and thus may provide an elastic force for a long term. Moreover, due to its hollow structure, the helical spring not only enables the main shaft to smoothly penetrate through, but also plays a role of positioning.

Alternatively, the elastic element comprises a first magnet and a second magnet, the first magnet and the second magnet being arranged such that same polarities are arranged opposite to each other to generate an elastic repulsive force; wherein the first magnet is provided at the positioning assembly, and the second magnet is provided at the bottom of the opening structure; a through hole guiding the main shaft to penetrate through is provided for the first magnet and the second magnet, respectively. The elastic repulsive force between two mutually repulsive magnets facilitates elastic press-fitting between the resilient face and the rotating face; moreover, since the magnetic force is gained rapidly but uneasily depleted, a material deformation noise caused by a mechanical spring is prevented.

Furthermore, a jewelry top assembly is provided on the rotating assembly, a toothed convex line is provided at the edge of the rotating face, and the rotating assembly is connected with the jewelry top assembly through the toothed convex line. The jewelry top assembly is provided with a pearl or gem material for decorative or aesthetic purposes, and the jewelry top assembly is rotatably mounted on the rotating assembly, thereby enhancing playability of the entire jewelry item.

Furthermore, a side surface of the positioning assembly is provided with a guide slot recessed from outward to inward, and a guide rib fitted with the guide slot is provided on the inner wall of the opening structure of the main body part. Activated by the elastic force of the elastic element and the pushing force for pushing the protrusion out of the recess, the positioning assembly moves reciprocally in the main body part along the guide rib. The guide slot and the guide rib are configured to guide motion direction of the positioning assembly, thereby avoiding the positioning assembly from being driven to rotate when the rotating assembly is rotating.

Furthermore, a through hole for guiding the main shaft to penetrate through is provided for the positioning assembly. Activated by the elastic force of the elastic element and the pushing force for pushing the protrusion out of the recess, the positioning assembly moves reciprocally along the main shaft. The through hole plays a role of guiding and fixing the positioning assembly to thereby define the motion direction of the positioning assembly and prevent rotation-induced displacement of the positioning assembly.

Furthermore, a revolving hole guiding the main shaft to penetrate through is provided at the bottom of the opening structure, the main shaft being rotatable in the revolving hole, wherein the main shaft, after penetrating through the revolving hole, is connected with a bayonet member outside the opening structure. The bayonet member is configured to axially position the main shaft. The rotating assembly rotates about the main shaft as axis; therefore, the main shaft is required not to break loose from the main body part while ensuring spinnability. The bayonet member on the main shaft configured to clasp outside the revolving hole not only enables the main shaft to rotate in the revolving hole but also prevents the main shaft from breaking loose along the axial direction.

Furthermore, the bayonet member has a ring shape. The main shaft penetrates through the ring of the bayonet member and is securely connected. A rotating slot for the bayonet member to rotate is provided at the bottom of the opening structure. The rotating slot is configured to hide the bayonet member that has a ring-shaped bayonet, such that the bayonet member does not protrude above the main body part, thereby not affecting the overall appearance of the jewelry item; with the main shaft as axis, the angles of the jewelry item when rotating in the rotating slot are all identical, such that the rotation is unlikely hampered.

Furthermore, the jewelry item refers to a ring, and a saddle-shaped slot suitable for a finger to wear is provided at the bottom of the main body part. The saddle-shaped slot is adapted to the finger profile so as to offer a higher comfort when being worn.

Furthermore, the jewelry item refers to pendant, earring, brooch, bracelet, anklet, or necklace. The jewelry item as disclosed may be applied to various species of jewelry, preferably applied to a jewelry item facilitating a hand to touch and spin, thereby exerting its property of spinnability.

DETAILED DESCRIPTION

Hereinafter, a spinnable jewelry item according to the present disclosure will be described in detail with reference to the accompanying drawings so as to explain and illustrate the protection scope of the present disclosure.

First Embodiment

Figure 1:
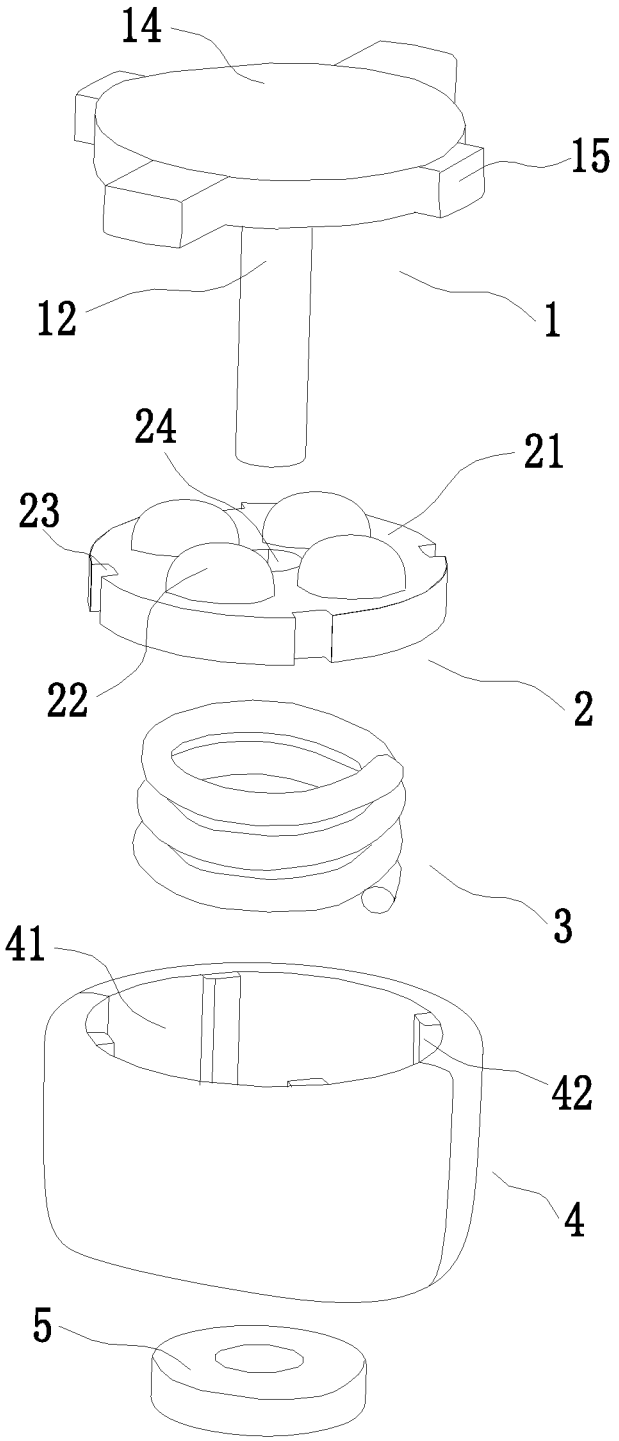
FIG. 1 is an exploded view of a spinnable jewelry item according to a first embodiment of the present disclosure.
Figure 3:
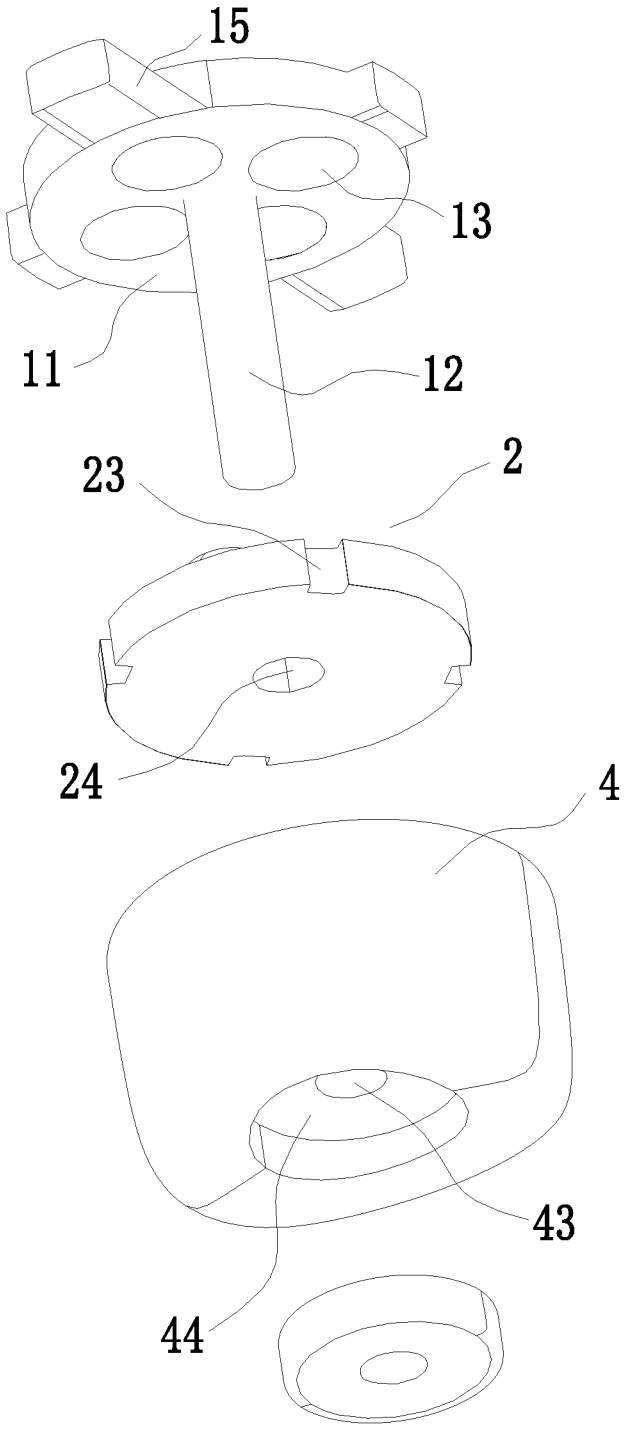
FIG. 3 is a partially exploded view of the spinnable jewelry item from a perspective different from the first embodiment and the second embodiment of the present disclosure.

As illustrated in FIG. 1 and FIG. 3, a spinnable jewelry comprises:

- a rotating assembly 1, which has a rotating face 11 and a main shaft 12 connected with the rotating face 11, wherein the rotating face 11 rotates about the main shaft 12 as axis;
- a positioning assembly 2, which has a positioning face 21, wherein the positioning face 21 elastically abuts against the rotating face 11 along the axial direction of the main shaft 12; a protrusion 22 and a recess 13 opposite the protrusion 22 are provided on opposite surfaces of the positioning face 21 and the rotating face 11, respectively, such that when the rotating face 11 is rotated, the protrusion 22 enters or exits the recess 13, wherein when the protrusion 22 enters the recess 13, a position where the rotating face 11 lies in a stationary state is defined;
- an elastic element 3, which applies an elastic force to the positioning assembly 2, such that the positioning face 21 elastically abuts against the rotating face 11. In this embodiment, the elastic element 3 is preferably a helical spring, one end of which abuts against the bottom of the opening structure 41 and the other end of which abuts against the positioning assembly 2, wherein the main shaft 12 penetrates through the center of the helical spring. Owing to its miniature structure, the helical spring is suitable for being embedded in a miniature jewelry item; besides, the helical spring, owing to its mature manufacture process, may provide a stable, lasting elastic force. Moreover, due to its hollow structure, the helical spring not only enables the main shaft 12 to smoothly penetrate through, but also plays a role of positioning;
- a main body part 4, which has an opening structure 41, wherein the main shaft 12 is rotatably connected to the bottom of the opening structure 41 after passing through the positioning assembly 2 and the elastic element 3, the positioning assembly 2 and the elastic element 3 being disposed in the opening structure 41.

Conventional jewelry is mostly invariable in pattern and thus has less fun and versatility. Even there is a movable part, such jewelry generally can only wobble randomly with mobility of the wearer, being hardly fixed to a particular angle. In the present disclosure, since the rotating assembly 1 in the spinnable jewelry item is rotatable, the jewelry item can vary its pattern. The present disclosure further provides a positioning assembly 2, wherein the positioning face 21 and the rotating face 11 may not only rotate relative to each other, but also may be fixed at a recessed position 13 where the rotated jewelry item stays. To achieve a better spinning effect, an elastic element 3 is specifically provided to enable resilient abutting between the positioning face 21 and the rotating face 11. When it is not desired to spin the jewelry item, the elastic force enables the protrusion 22 to be depressed into the recess 13, thereby fixing the position of the rotating face 11; when it is desired to spin the jewelry item, the jewelry item can be rotated by overcoming the friction generated by the elastic force. The main body part 4 provides a base for mounting and rotating the rotating assembly 1, the positioning assembly 2, and the elastic element 3, wherein the opening structure 41 of the main body part 4 serves to fix the rotated position of the main shaft 12 and meanwhile conceal the components therein so as not to affect the appearance of the jewelry item. Therefore, the spinnable jewelry item in this solution can be rotated and positioned. When wearing it, the wearer may fidget with the jewelry item at will at any time and exhibit respective views of the jewelry item, thereby enhancing interactivity between the jewelry item and the wearer and better satisfying the wearer's demand on versality.

In the present disclosure, the protrusion 22 and the recess 13 serve to fix the stationary position of the rotating face 11 when the rotating face 11 completes spinning; the protrusion and the recess are disposed on the rotating face 11 and the positioning face 21, respectively, corresponding to each other, wherein dispositions of the protrusion and the recess are interchangeable between the rotating face and the positioning face. In this embodiment, the protrusion 22 is preferably disposed on the rotating face 11, while the recess 13 is provided on the positioning face 21 at the trajectory along which the protrusion 22 rotates. As to layout of the specific positions of the protrusion 22 and the recess 13, it is configured that when one of the protrusion 22 and the recess 13 is rotating, the other one is positioned at the trajectory of rotating so as to ensure that the protrusion 22 is snapped into the recess 13 after the rotating, thereby exerting the recess's role of stationary positioning.

The specific structures and numbers of the protrusion 22 and the recess 13 may be flexibly adjusted based on desired spinning and varying patterns of the jewelry item. In this embodiment, four recesses 13 are disposed at even intervals with every two neighboring recesses 13 forming a right angle, wherein the four recesses 13 correspond to four stationary-state positions of the rotating face 11, respectively. Such settings enable support and positioning at all of the 0°, 90°, 180°, and 270° angles, and the four-angle symmetrical structure ensures a balanced. stable stress, causing the jewelry item unlikely to wobble. Moreover, less numbers of the recesses 13 and protrusions 22 lower manufacture complexity. Furthermore, desired rotation and positioning may be realized so long as the number of the recesses is equal to or greater than the number of the protrusions. When the number of the recesses is equal to that of the protrusions, the recesses are in exactly one-to-one correspondence with the protrusions, realizing a more stable rotation; when the number of the recesses is greater than that of the protrusions, multi-point positioning is enabled and manufacturing is simplified.

The protrusion and recess may also adopt a variety of shapes. Preferably, the protrusion 22 is a semi-spherical protrusion 22, while the recess 13 is a semi-spherical slot adapted to the protrusion 22. As the semi-spherical shape has a regular spherical surface, it is easily manufactured. Moreover, the arc-shaped profile of the spherical surface facilitates the protrusion 22 to switch between recesses 13 during the spinning; and since less effort is needed for the switching operation, the jewelry item is adapted for frequent spinning.

Besides the above shapes, when satisfying the conditions for rotating to be positioned, the protrusion 22 has an arc shape with a curved surface while the recess 13 is an arc-shaped slot adapted to the protrusion. The arc-shaped protrusion 22 has a smooth edge, such that when spinning, the protrusion 22 may easily switch between recesses 13, facilitating the user to spin the jewelry item at will. Or, the protrusion 22 is a wedge-shaped protrusion with a beveled surface and the recess 13 is a wedge-shaped slot adapted to the protrusion 22. Compared with other shapes, the beveled surface facilitates the wedge-shaped protrusion 22 to rotate out of the corresponding recess 13 during spinning, but is more difficultly displaced than the arc-shaped surface. In this way, motion variations are generated, thereby enhancing playability of the spinning. The wedge-shaped protrusion is more suitable for keeping the jewelry item at a fixed position for a long term after spinning, unlikely to be displaced by a minor external force.

During spinning, the elastic force applied by the elastic element 3 also facilitates the protrusion 22 to be quickly pushed into the corresponding recess 13, such that during the spinning, the protrusion 22 may quickly switch from one recess 13 into another recess 13 to be positioned, thereby offering a better hand sense during the spinning. A clash sound is emitted when the protrusion 22 is pushed into the recess 13. A continuous "click, click . . . " clash sound is emitted during a continuous spinning. The user may sense a noticeable hand feedback and receive a position-switching alarm during the spinning. Different clash sounds may be emitted by setting the material and resiliency of the clashed surfaces. Such clash sounds may also provide more fun when the user wears the spinnable jewelry item of the present disclosure. Besides the above structure, the number of the recesses 13 may also be equal to or greater than the number of the protrusions 22. For example, one protrusion 22 corresponds to a plurality of recesses 13. The recesses 13 may have different depths or bottom shapes. Then, when the protrusion 22 enters different recesses 13, different sounds may be emitted; when the protrusion 22 continues spinning through a plurality of different recesses 13, even a melody may be created, further enhancing fun and playability.

To fix the jewelry, a jewelry top assembly 14 is provided on the rotating assembly 1, a toothed convex line 15 is provided at the edge of the rotating face 11, and the rotating assembly is connected with the jewelry top assembly 14 through the toothed convex line 15. The jewelry top assembly 14 is provided with a pearl or gem material for decorative or aesthetic purposes, and the jewelry top assembly 14 is rotatably mounted on the rotating assembly, thereby enhancing playability of the entire jewelry item.

A side surface of the positioning assembly 2 is provided with a guide slot 23 recessed from outward to inward, and a guide rib 42 fitted with the guide slot 23 is provided on the inner wall of the opening structure 41 of the main body 4. Activated by the elastic force of the elastic element 3 and the pushing force for pushing the protrusion 22 out of the recess 13, the positioning assembly 2 moves reciprocally in the main body part 4 along the guide rib 42. When the protrusion 22 enters the recess 13, since the recess 13 is located farther from the positioning assembly 2 than other components, the positioning assembly 2 is subjected to the elastic force to be driven towards the direction of the rotating assembly 1; when the protrusion 22 exits from the recess 13, the positioning assembly 2 moves towards a reverse direction. The guide slot 23 and the guide rib 42 are configured to guide motion direction of the positioning assembly 2, thereby avoiding the positioning assembly 2 from being driven to rotate when the rotating assembly 1 is rotating.

The main shaft 12 and the main body part 4 may be fixed in a plurality of manners. In this embodiment, a through hole 24 for guiding the main shaft 12 to penetrate through is provided for the positioning assembly 2. Activated by the elastic force of the elastic element 3 and the pushing force for pushing the protrusion 22 out of the recess 13, the positioning assembly 2 moves reciprocally along the main shaft 12. The through hole 24 plays a role of guiding and fixing the positioning assembly 2 to thereby define the motion direction of the positioning assembly 2 and prevent rotation-induced displacement of the positioning assembly 2. A revolving hole 43 guiding the main shaft 12 to penetrate through is provided at the bottom of the opening structure 41, the main shaft 12 being rotatable in the revolving hole 43, wherein the main shaft 12, after penetrating through the revolving hole 43, is connected with a bayonet member 5 outside the opening structure 41. The bayonet member 5 is configured to axially position the main shaft 12. The rotating assembly 1 rotates about the main shaft 12 as axis; therefore, the main shaft 12 is required not to break loose from the main body part 4 while ensuring spinnability. The bayonet member 5 on the main shaft 12 configured to clasp outside the revolving hole 43 not only enables the main shaft 12 to rotate in the revolving hole 43 but also prevents the main shaft 12 from breaking loose along the axial direction. The bayonet member 5 has a ring shape. The main shaft 12 penetrates through the ring of the bayonet member 5 and is securely connected. A rotating slot 44 for the bayonet member 5 to rotate is provided at the bottom of the opening structure 41. The rotating slot 44 is configured to hide the bayonet member 5 that has a ring-shaped bayonet, such that the bayonet member 5 does not protrude above the main body part 4 so as not to affect the overall appearance of the jewelry item; with the main shaft 12 as axis, the angles of the jewelry item when rotating in the rotating slot 44 are all identical, such that the rotation is unlikely hampered.

The jewelry in the embodiment may refer to various species of jewelry, for example, a ring, pendant, earring, brooch, bracelet, anklet, necklace, or headwear, which is not enumerated here. When the jewelry item refers to a ring, a saddle-shaped slot suitable for a finger to wear is provided at the bottom of the main body part 4. The saddle-shaped slot is adapted to the finger profile so as to offer a higher comfort when being worn. When the jewelry refers to pendant, a pendant chain for wearing may be further provided. Based on the pendant style, the pendant chain may be positioned on the main body part 4 or other parts of the jewelry item.

Second Embodiment

Figure 2:
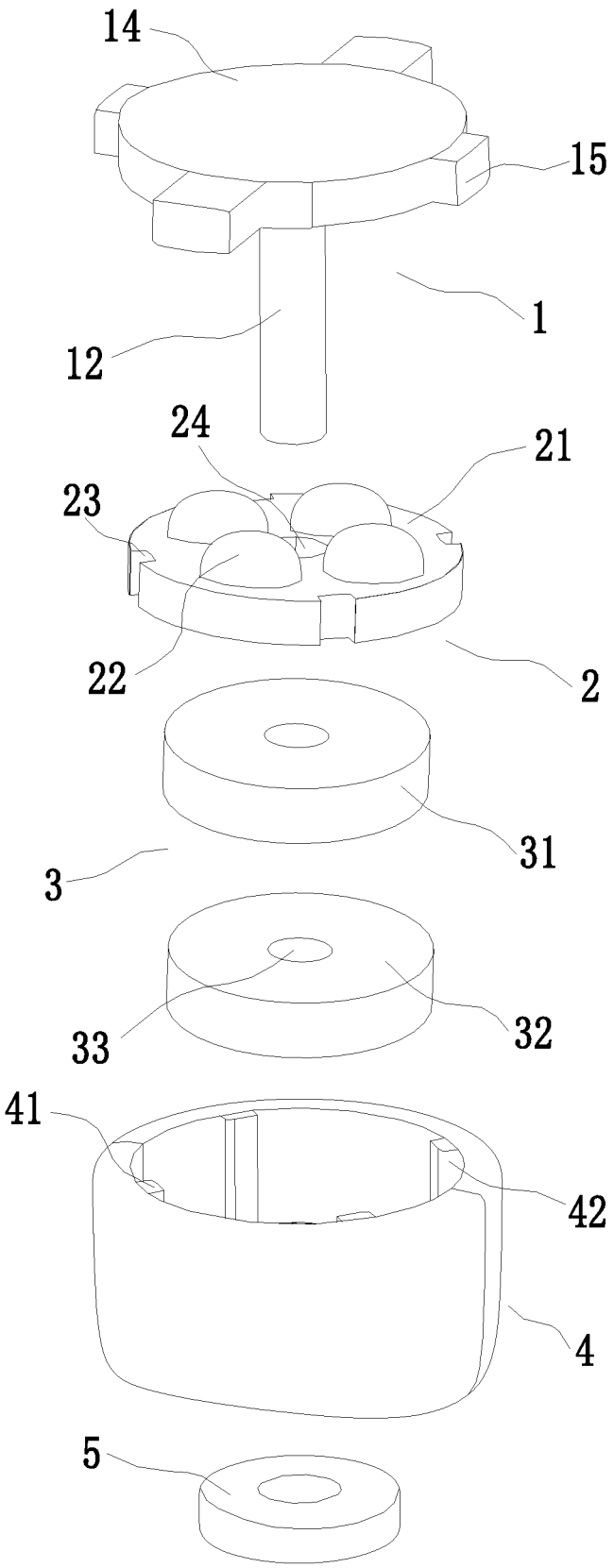
FIG. 2 is an exploded view of a spinnable jewelry item according to a second embodiment of the present disclosure.

This embodiment is based on the first embodiment, except that a different elastic element is adopted, as illustrated in FIG. 2 and FIG. 3. The specific solution is provided below:

a spinnable jewelry, comprising:

a rotating assembly 1, which has a rotating face 11 and a main shaft 12 connected with the rotating face 11, wherein the rotating face 11 rotates about the main shaft 12 as axis;

a positioning assembly 2, which has a positioning face 21, wherein the positioning face 21 elastically abuts against the rotating face 11 along the axial direction of the main shaft 12; a protrusion 22 and a recess 13 opposite the protrusion 22 are provided on opposite surfaces of the positioning face 21 and the rotating face 11, respectively, such that when the rotating face 11 is rotated, the protrusion 22 enters or exits the recess 13, wherein when the protrusion 22 enters the recess 13, a position where the rotating face 11 lies in a stationary state is defined;

an elastic element 3, which applies an elastic force to the positioning assembly 2, such that the positioning face 21 elastically abuts against the rotating face 11, wherein the elastic element 3 comprises a first magnet 31 and a second magnet 32, the first magnet 31 and the second magnet 32 being arranged such that same polarities are arranged opposite to each other to generate an elastic repulsive force;

wherein the first magnet 31 is provided at the positioning assembly 2, and the second magnet 32 is provided at the bottom of the opening structure 41; a through hole 33 guiding the main shaft 12 to penetrate through is provided for the first magnet 31 and the second magnet 32, respectively; and a main body part 4, which has an opening structure 41, wherein the main shaft 12 is rotatably connected to the bottom of the opening structure 41 after passing through the positioning assembly 2 and the elastic element 3, the positioning assembly 2 and the elastic element 3 being disposed in the opening structure 41.

In this embodiment, the elastic repulsive force between two mutually repulsive magnets facilitates elastic press-fitting between the resilient face and the rotating face 11; moreover, since the magnetic force is gained rapidly but uneasily depleted, a material deformation noise caused by a mechanical spring is prevented. The first magnet 31 and the second magnet 32 may not contact at all, avoiding rotational friction during the spinning process, rendering the elastic element 3 more durable. The direction of the repulsive force is also defined by the through hole 33 through which the main shaft 12 penetrates, avoiding failure of the elastic element 3 due to displacement of the first magnet 31 and the second magnet 32 during the spinning process.

Based on the illustrations and teachings of the disclosure, those skilled in the art may also alter and modify the embodiments above. Therefore, the present disclosure is not limited to the preferred embodiments as illustrated and described, and some alterations and modifications to the present disclosure should also fall into the protection scope of the appended claims. In addition, although some specific terms are used herein, such terms are only for facilitating the illustration, constituting no limitation to the present disclosure.

I claim:

1. A spinnable jewelry item, comprising:

a rotating assembly, which has a rotating face and a main shaft connected with the rotating face, wherein the rotating face rotates about the main shaft as axis;

a positioning assembly, which has a positioning face, wherein the positioning face elastically abuts against the rotating face along the axial direction of the main shaft; a protrusion and a recess opposite the protrusion are provided on opposite surfaces of the positioning face and the rotating face, respectively, such that when the rotating face is rotated, the protrusion enters or exits the recess, wherein when the protrusion enters the recess, a position where the rotating face lies in a stationary state is defined;

an elastic element, which applies an elastic force to the positioning assembly, such that the positioning face elastically abuts against the rotating face; and a main body part, which has an opening structure, wherein the main shaft is rotatably connected to a bottom of the opening structure after passing through the positioning assembly and the elastic element, the positioning assembly and the elastic element being disposed in the opening structure.

2. The spinnable jewelry item according to claim 1, wherein:

the protrusion is disposed on the rotating face, while the recess is provided on the positioning face at a trajectory along which the protrusion rotates.

3. The spinnable jewelry item according to claim 2, wherein:

a plurality of recesses are provided at even intervals, corresponding to a plurality of stationary-state positions on the rotating face.

4. The spinnable jewelry item according to claim 3, wherein:

four recesses are disposed at even intervals with every two neighboring recesses forming a right angle, corresponding to four stationary-state positions of the rotating face, respectively.

5. The spinnable jewelry item according to claim 1, wherein:

the recess is disposed on the rotating face, while the protrusion is provided on the positioning face at a trajectory along which the recess rotates.

6. The spinnable jewelry item according to claim 1, wherein:

the number of recesses is equal to or greater than the number of protrusions.

7. The spinnable jewelry item according to claim 1, wherein:

the protrusion is a semi-spherical protrusion, while the recess is a semi-spherical slot adapted to the protrusion.

8. The spinnable jewelry item according to claim 1, wherein:

the protrusion has an arc shape with a curved surface while the recess is an arc-shaped slot adapted to the protrusion.

9. The spinnable jewelry item according to claim 1, wherein:

the protrusion is a wedge-shaped protrusion with a beveled surface and the recess is a wedge-shaped slot adapted to the protrusion.

10. The spinnable jewelry item according to claim 1, wherein:

the elastic force applied by the elastic element facilitates the protrusion to be quickly pushed into a corresponding recess.

11. The spinnable jewelry item according to claim 10, wherein a clash sound is emitted when the protrusion is pushed into the recess.

12. The spinnable jewelry item according to claim 1, wherein:

the elastic element is a helical spring, one end of which abuts against the bottom of the opening structure and the other end of which abuts against the positioning assembly, wherein the main shaft penetrates through a center of the helical spring.

13. The spinnable jewelry item according to claim 1, wherein:

the elastic element comprises a first magnet and a second magnet, the first magnet and the second magnet being arranged such that same polarities are arranged opposite to each other to generate an elastic repulsive force; wherein the first magnet is provided at the positioning assembly, and the second magnet is provided at the bottom of the opening structure; a through hole guiding the main shaft to penetrate through is provided for the first magnet and the second magnet, respectively.

14. The spinnable jewelry item according to claim 1, wherein:

a jewelry top assembly is provided on the rotating assembly, a toothed convex line is provided at an edge of the rotating face, and the rotating assembly is connected with the jewelry top assembly through the toothed convex line.

15. The spinnable jewelry item according to claim 1, wherein:

a side surface of the positioning assembly is provided with a guide slot recessed from outward to inward, and a guide rib fitted with the guide slot is provided on the inner wall of the opening structure of the main body; wherein, activated by the elastic force of the elastic element and a pushing force for pushing the protrusions out of the recesses, the positioning assembly moves reciprocally in the main body part along the guide rib.

16. The spinnable jewelry item according to claim 1, wherein:

a through hole for guiding the main shaft to penetrate through is provided for the positioning assembly; wherein activated by the elastic force of the elastic element and a pushing force for pushing the protrusions out of the recesses, the positioning assembly moves reciprocally along the main shaft.

17. The spinnable jewelry item according to claim 1, wherein:

a hole guiding the main shaft to penetrate through is provided at the bottom of the opening structure, the main shaft being rotatable in the hole, wherein the main shaft, after penetrating through the hole, is connected with a bayonet member outside the opening structure; wherein the bayonet member is configured to axially position the main shaft.

18. The spinnable jewelry item according to claim 17, wherein:

the bayonet member has a ring shape; the main shaft penetrates through the ring of the bayonet member and is securely connected; and a rotating slot for the bayonet member to rotate is provided at the bottom of the opening structure.

19. The spinnable jewelry item according to claim 1, wherein:

the jewelry item refers to a ring, and a saddle-shaped slot suitable for a finger to wear is provided at a bottom of the main body part.

20. The spinnable jewelry item according to claim 1, wherein the jewelry item refers to pendant, earring, brooch, bracelet, anklet, or necklace.

* * * * *